US008016130B2

(12) United States Patent
Cheng

(10) Patent No.: US 8,016,130 B2
(45) Date of Patent: Sep. 13, 2011

(54) TOOL RACK

(76) Inventor: Chin-Shun Cheng, Taichung County (TW)

( * ) Notice: Subject to any disclaimer, the term of this patent is extended or adjusted under 35 U.S.C. 154(b) by 369 days.

(21) Appl. No.: 12/418,619

(22) Filed: Apr. 6, 2009

(65) Prior Publication Data

US 2010/0252512 A1 Oct. 7, 2010

(51) Int. Cl.
*A47F 7/00* (2006.01)

(52) U.S. Cl. ..... 211/70.6; 211/60.1; 206/349; 206/372; 206/376

(58) Field of Classification Search ..... 211/70.6, 211/69, 87.01, 60.1, 4, 70.8; 206/376, 372, 206/373, 377, 378
See application file for complete search history.

(56) References Cited

U.S. PATENT DOCUMENTS

| | | | | |
|---|---|---|---|---|
| 2,068,308 | A * | 1/1937 | Zerver | 206/376 |
| 2,465,290 | A * | 3/1949 | Sorenson | 206/376 |
| 5,020,666 | A * | 6/1991 | Barlean | 206/376 |
| 5,203,469 | A * | 4/1993 | Chang et al. | 220/812 |
| 5,598,924 | A * | 2/1997 | McCann | 206/372 |
| 6,305,542 | B1 * | 10/2001 | Barbrow | 206/376 |
| 6,360,892 | B1 * | 3/2002 | Chen | 206/376 |
| 6,536,611 | B2 * | 3/2003 | Chen | 211/70.6 |
| 6,637,606 | B1 * | 10/2003 | Chen | 211/70.6 |
| 6,758,350 | B2 * | 7/2004 | Lin | 211/70.6 |
| 6,832,684 | B2 * | 12/2004 | Huang | 206/376 |
| 6,837,382 | B2 * | 1/2005 | Chen | 211/70.6 |
| 7,055,689 | B2 * | 6/2006 | Chen | 206/376 |
| 7,815,058 | B2 * | 10/2010 | Cheng | 211/70.6 |
| 2010/0044327 | A1 * | 2/2010 | Vecchio et al. | 211/70.6 |
| 2010/0065522 | A1 * | 3/2010 | Cheng | 211/85.8 |

* cited by examiner

*Primary Examiner* — Darnell Jayne
*Assistant Examiner* — Stanton L Krycinski

(57) ABSTRACT

This invention discloses a set of tool rack which can particularly place multiple wrenches. It is mainly comprised of a main frame, a front cover panel and two locking members. The main frame includes an axial rod, a connecting plate and two side plates. The axial rod provides the openings of the wrenches to hold on. Each side plate includes a guiding slot and a locking hole. The guiding slot starts from the rear end of the side plate, extended around the axis of the axial rod, and then ends to the front end of the side plate. Between the two side plates are multiple receiving recesses for the shanks of the wrenches to be engaged. The front cover panel includes a cover plate and two curved side plates having protruding columns inserted over the guiding slot so that the cover plate is moveable along the guiding slots.

10 Claims, 15 Drawing Sheets

C-C

A-A

B-B

D-D

TOOL RACK

FIELD OF THE INVENTION

The present invention relates to a set of tool rack which can particularly be placed with multiple wrenches. Its front cover panel is moveable for control of opening or closing the rack, in order to prevent from stealing. It is convenient to use the tool rack and it can reduce the space taken by those wrenches.

BACKGROUND OF THE INVENTION

The prior tool rack developed by the inventor has been registered with U.S. patent application Ser. No. 11/616,856 in the United States. It includes a frame, a restriction member, and multiple locking members. The frame has multiple receiving recesses established laterally in parallel, and each receiving recess is composed of two clamp plates to hold wrenches in different sizes with parallel distance. Each clamp plate has a spring piece which biases the tool to position the tool within the receiving recesses. A restriction member is transversely slidably connected to the frame and includes multiple restriction portions which are snapped on the tools to prevent the tools from being taken out easily by unidentified force. Locking members lock up the restriction member onto the frame when the clamp plates hold tools.

However, the tool rack mentioned above still has some disadvantages:

1. The clamp plates protrude from the frame and their edges can easily be hooked by external matters due to short of cover protection. For example, they might tangle with user's sleeves or clothes, and cause inconvenience to use the tools.

2. The multiple clamp plates are densely arranged on the frame and their exposure makes the frame look awkward.

3. When wrenches are placed on the rack, the driving heads of the wrenches protrude out from the frame and may be hit by stiff matters. This may damage the driving heads of the wrenches.

SUMMARY OF THE INVENTION

The purpose of the invention is to provide a special design of tool rack that is able to place multiple wrenches. It can effectively keep the wrenches in position, and prevent from stealing. The tool rack is designed to be used friendly. It is expected to reduce the space taken by those wrenches as well.

In order to accomplish the purpose mentioned above, there are certain techniques applied. The tool rack comprises a main frame, a front cover panel and two locking members. The main frame includes one axial rod, one connecting plate and two side plates.

One long and narrow guiding slot and at least one locking hole are provided on each side plate. Between the two side plates and the connecting plate, there are multiple receiving recesses for insertion of shanks of wrenches. The axial rod is applied to hold on the openings at the ends of the shanks.

The front cover panel includes a cover plate and two curved side plates. On the curved side plates are protruding columns used to penetrate the guiding slots. The cover plate will be able to cover up the exposure of the receiving recesses when the front cover panel is moved.

The locking members are inserted through the locking holes of the side plates, and stop the front cover panel from moving. Therefore, the front cover panel can be fixed in position, covering right in front of the receiving recesses

DETAILED DESCRIPTION OF THE PREFERRED EMBODIMENT

Figure 1:
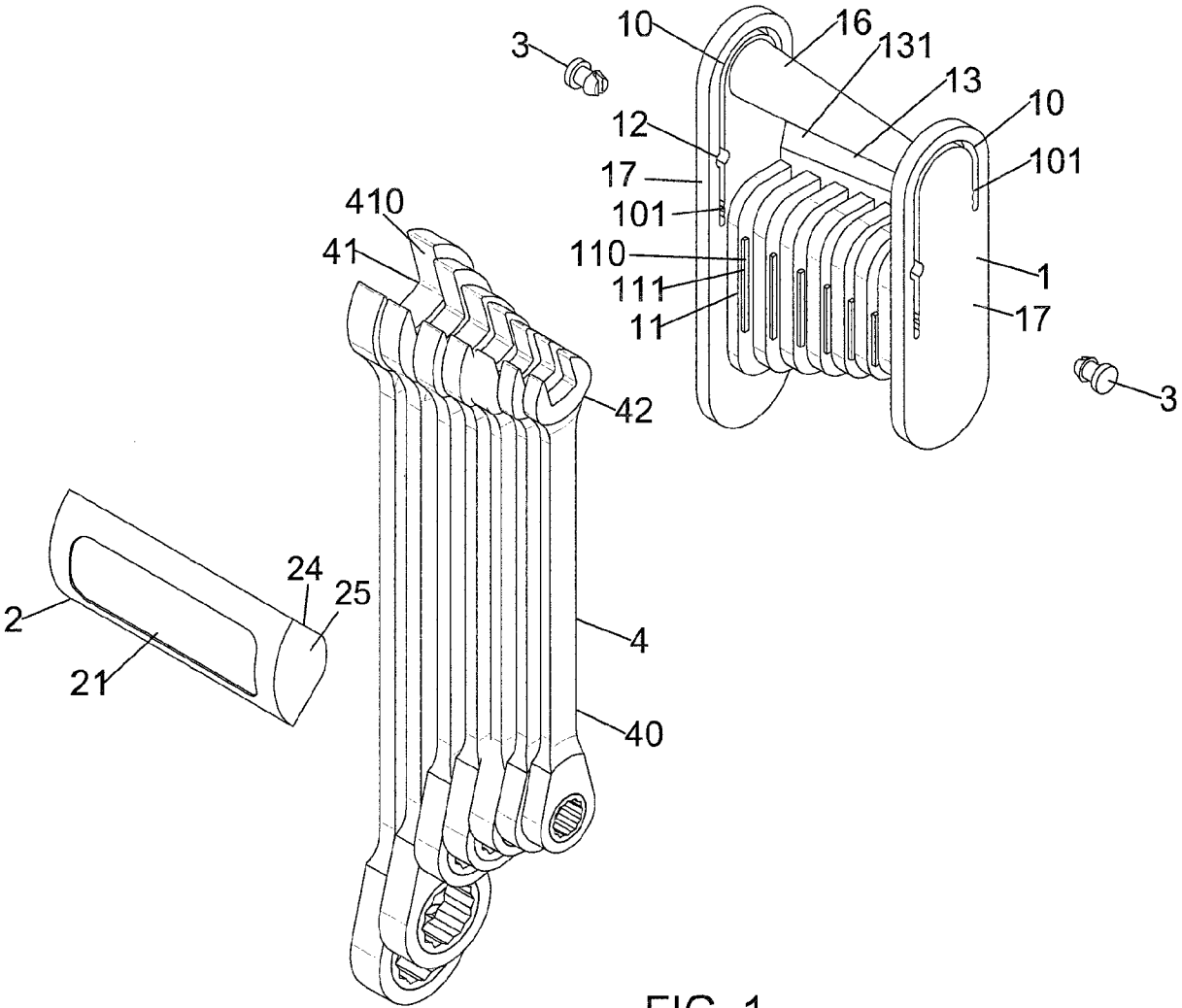
FIG. 1 is an exploded view to show the tool rack of the present invention.
Figure 2:
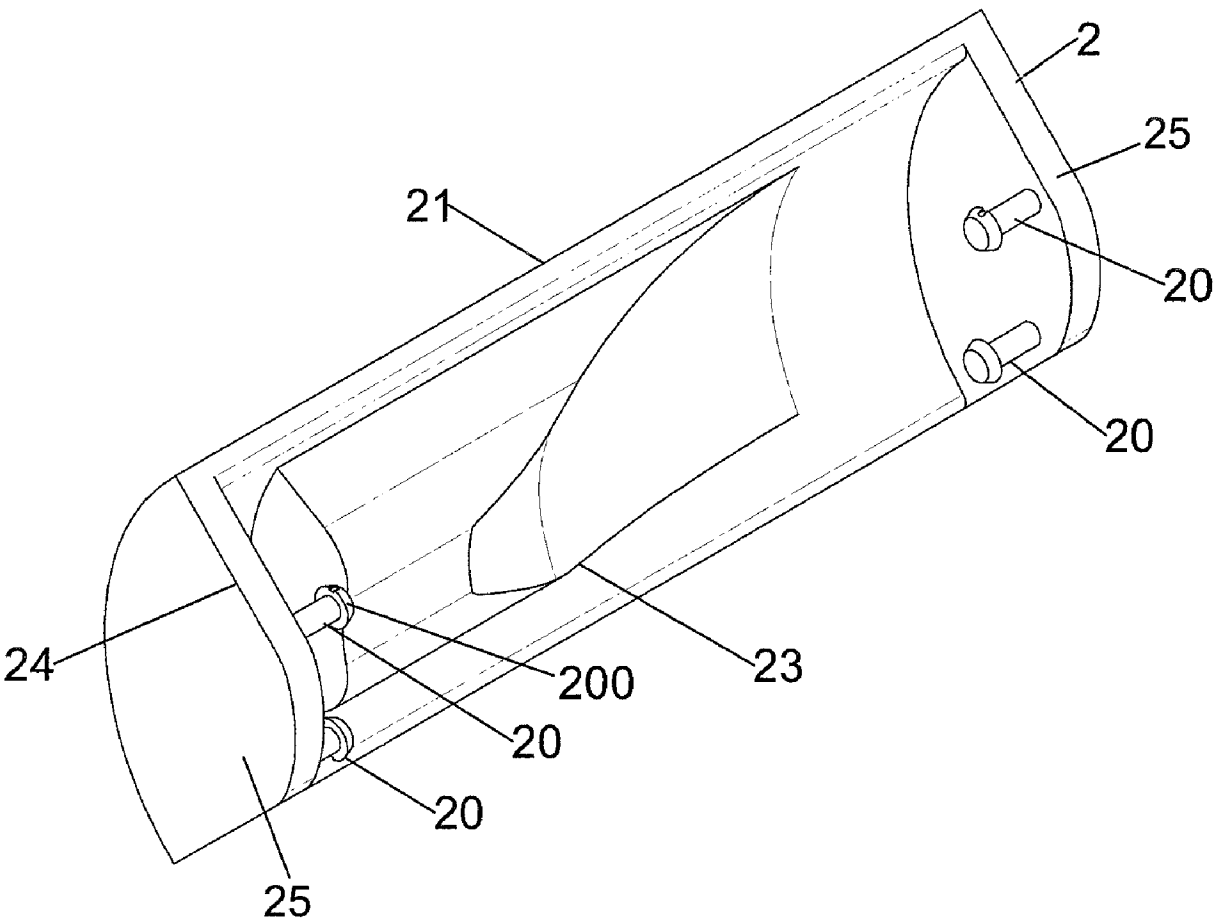
FIG. 2 is a perspective view to show the front cover panel of the present invention.
Figure 3:
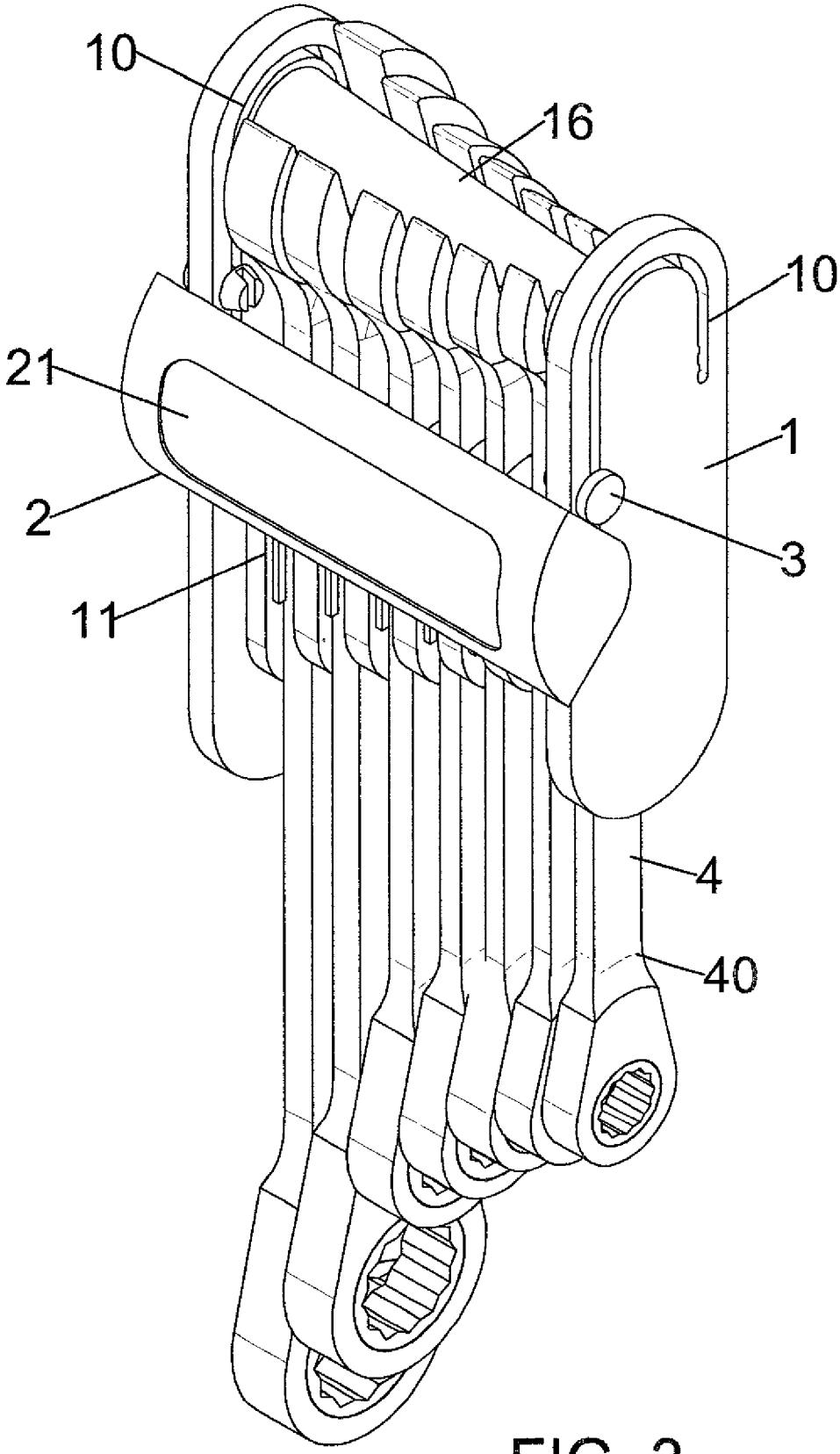
FIG. 3 is a schematic drawing to show the tool rack with the front cover panel closed of the present invention.

Referring to FIGS. 1-3, the tool rack of the present invention comprises a main frame 1, a front cover panel 2 and two locking members 3. It is able to place and hold multiple wrenches 4. The structure of above components is detailed as bellow:

The main frame 1 includes two side plates 17, one connecting plate 13 horizontally linking between two side plates 17, and one axial rod 16. The side plates 17 are located on both sides of the main frame 1 respectively. The connecting plate 13 is installed at the rear side of the main frame 1, and the axial rod 16 is installed on top of the main frame 1. Each side plate 17 has a long and narrow guiding slot 10 penetrating along the upper portion of the side plate 17. The guiding slot 10 starts from the rear end of the side plate 17, extends around the axis of the axial rod 16, and then ends to the front end of the side plate 17. At the both distal ends of the guiding slot 10, there is a plurality of stopping edges 101 extruded from the inner sidewalls. Among the side plates 17 and the connecting plate 13, there is a plurality of receiving recesses 11 laterally established in parallel and facing to the front side of the main frame 1. There are seven receiving recesses 11 shown on the current illustration drawings. A long raised strip 111 is uprightly installed on each sidewall, close to the opening 110 of the receiving recess 11. It is designed to reduce to space of the opening 110. There is a locking hole 12 drilled on each side plate 17, and it is also positioned on the guiding slot 10 and has an inner diameter larger than the width of the guiding slot 10. On the top of the connecting plate 13 is a top edge 131, and above receiving recesses 11 is an axially tapered axial rod 16.

The front cover panel 2 includes a cover plate 21 with a curved front surface provided on is front side, and two curved side plates 25 located on both sides of the cover plate 21. These two curved side plates 25 are used to connect to the side plates 17 of the main frame 1 from the outer sidewalls. There are two protruding columns 20 on each inner surface of the curved side plates 25. At the distal end of each protruding column 20 is a fungus shape head 200 with a bigger diameter than the column 20.

The protruding columns 20 are used to insert into the guiding slots 10, and are able to move along the slot 10. The cover plate 21 covers up the opening 110 of the receiving recesses 11, and there is a curved edge 23 laterally extended along the rear side of the cover plate 21. This curved edge 23 is designed to match the width of the shank 40 of each wrench 4, in order to reduce the gap between wrenches 4 and the front cover panel 2. The distal end of the curved side plate 25 is U-shaped, and there is a top edge 24 on the side plate 25 as well.

Inserted through the locking holes 12 of the main frame 1, the locking members 3 are against the top edge 24 of the front cover panel 2. Therefore, the front cover panel 2 can be fixed in front of the receiving recesses 11.

A shank 40 is defined as the middle portion of a wrench 4. The shank 40 is engaged in the receiving recess 11 of the main frame 1, and is restricted between the raised strip 111 and the curved edge 23 of the front cover panel 2. At one end of the wrench 4 is a driving head 41 with a U-shaped opening 410. The driving head 41 can be held by the axial rod 16, and its bottom portion is a conjunction neck 42 connected between the driving head 41 and the shank 40 of the wrench 4. The conjunction neck 42 of the wrench 4 is supported by the top edge 131 of the connecting plate 13, so the wrench 4 can be effectively restricted between the main frame 1 and the front cover panel 2. By doing so, the wrench 4 will not fall off easily.

Referring to FIGS. 1 to 6, the front cover panel 2 is installed on the main frame 1 after the assembly of the present invention. The protruding columns 20 are inserted through and over the guiding slots 10 and restricted by two stopping edges 101 to be in position. In the mean time, the cover plate 21 covers the openings 110 of the receiving recesses 11, and the locking members 3 pinned through and over the locking holes 12 are restricting against the top edges 24 of the curved side plates 25 to prevent the front cover panel 2 from moving freely. When the shank 40 of the wrench 4 is placed in the receiving recess 11, it will be restricted by the raised strip 111 of the receiving recess 11 and the curved edge 23 of the front cover panel 2. Because the driving head 41 of the wrench 4 is fixed by the axial rod 16 at the proper position according to the size of its opening 410, all the wrenches 4 can be uprightly arranged in parallel on the main frame 1.

Figure 7:
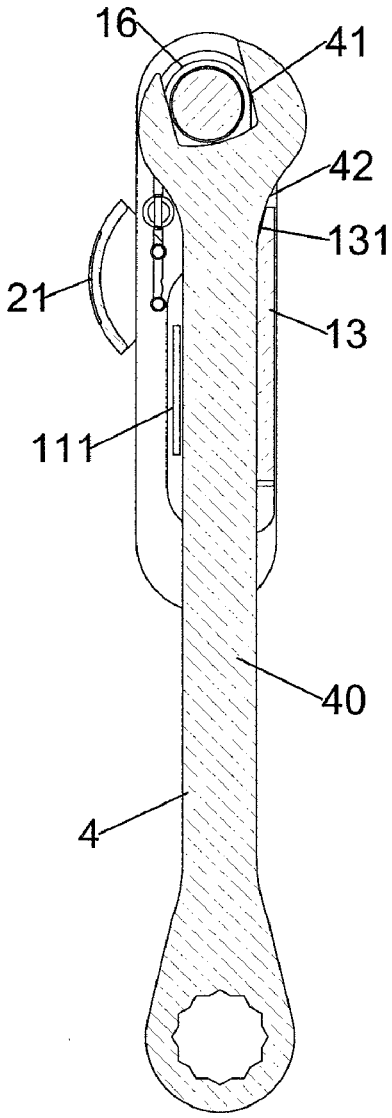
FIG. 7 is a cross sectional view, taken along line C-C in FIG. 4.
Figure 4:
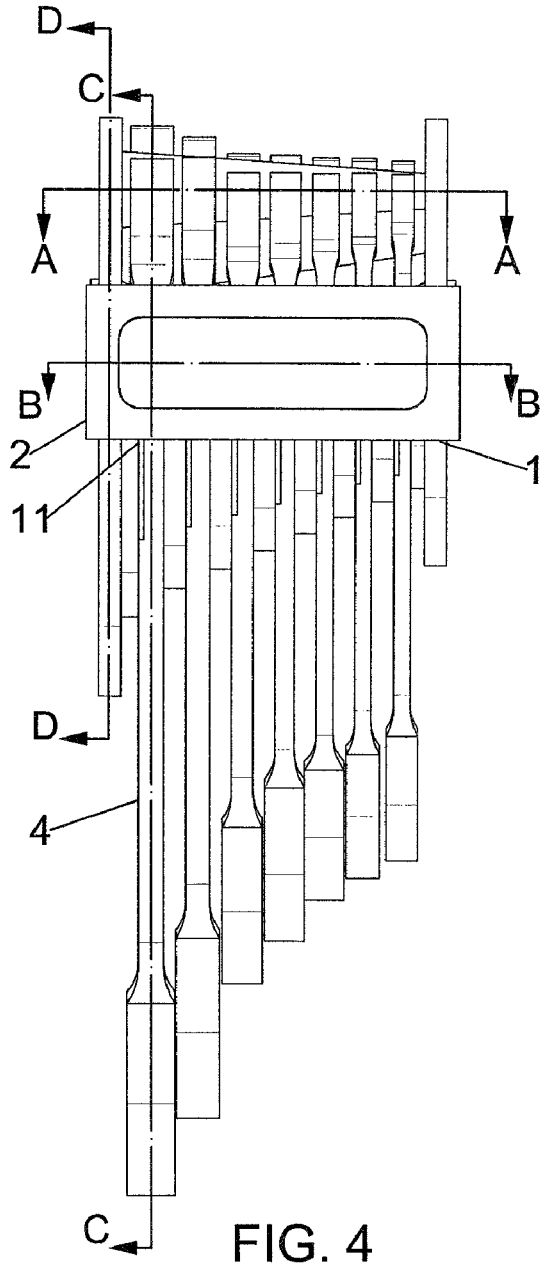
FIG. 4 is a front view to show the assembled tool rack with the front cover panel closed of the present invention.
Figure 5:
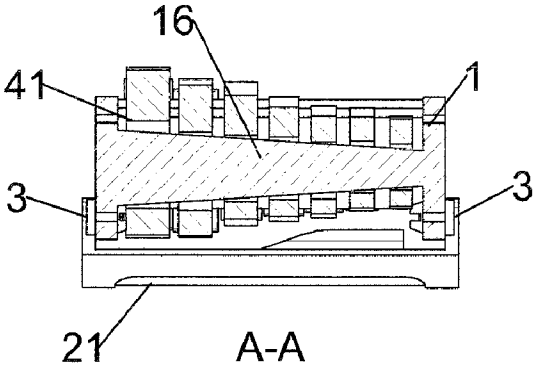
FIG. 5 is a cross sectional view, taken along line A-A in FIG. 4.
Figure 6:
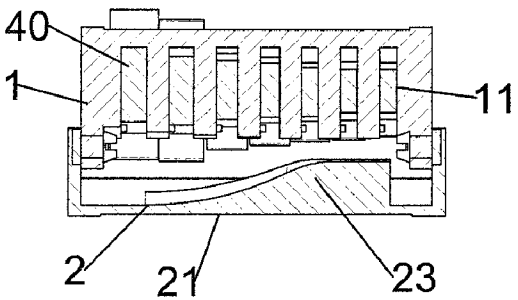
FIG. 6 is a cross sectional view, taken along line B-Bin FIG. 4.

Referring to FIG. 7, the shank 40 of the wrench 4 is engaged in the receiving recess 11, the driving head 41 is fixed by the axial rod 16, and the neck 42 of the driving head 41 of the wrench 4 is supported by the top edge 131 of the connecting plate 13. Therefore, the wrench 4 can be effectively placed in position.

Figure 8:
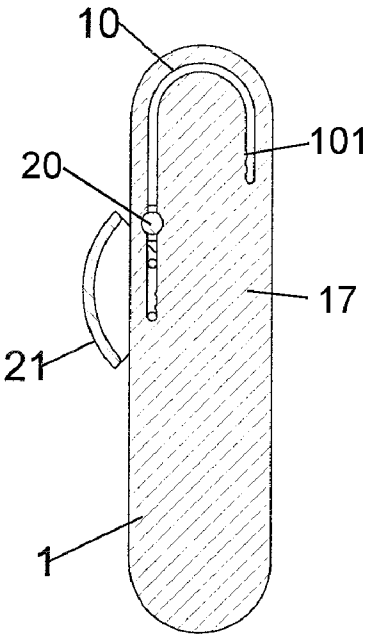
FIG. 8 is a cross sectional view, taken along line D-D in FIG. 4.
Figure 9:
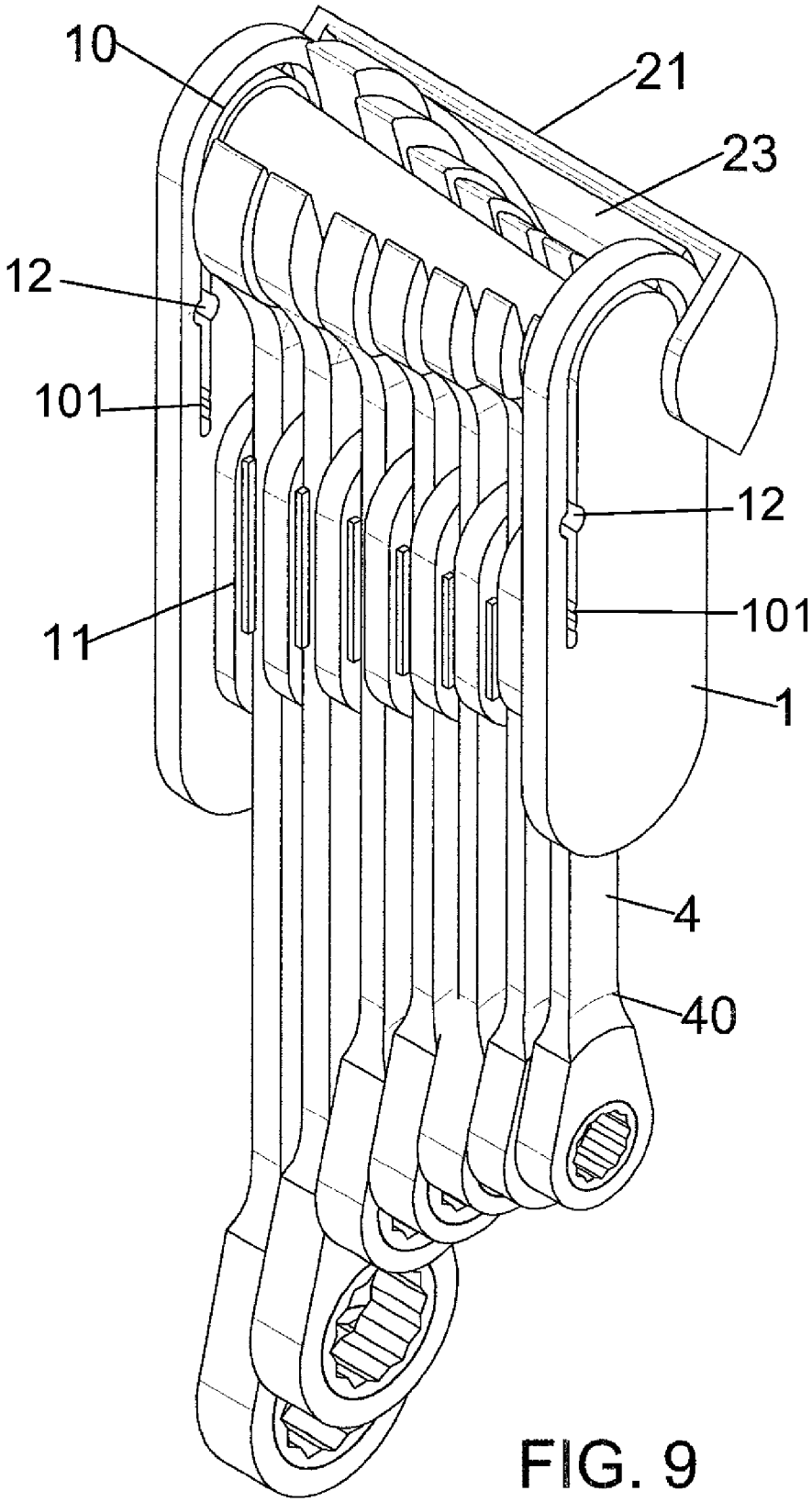
FIG. 9 is a schematic drawing to show the tool rack with the front cover panel opened of the present invention.

Referring to FIGS. 8 and 9, the protruding columns 20 of the front cover panel 2 are engaged between two stopping edges 101 of the guiding slot 10. The top edges 24 of the front cover panel 2 are restricted against the locking members 3, so the front cover panel 2 is fixed in position corresponding to the main frame 1 and covers up the openings 110 of the receiving recesses 11. By doing so, it can prevent wrenches 4 from stealing. When the locking members 3 are detached from the locking holes 12, the wrenches 4 can be taken out by moving the front cover panel 2 up. The protruding columns 20 will be disengaged from the stopping edges 101 and can be moved along the guiding slots 10 up to the other ends of the slots 10. The protruding columns 20 will be engaged to the two stopping edges 101 on the other ends again, and the openings 110 of the receiving recesses 11 will be disclosed shown as FIG. 9.

Figure 10:
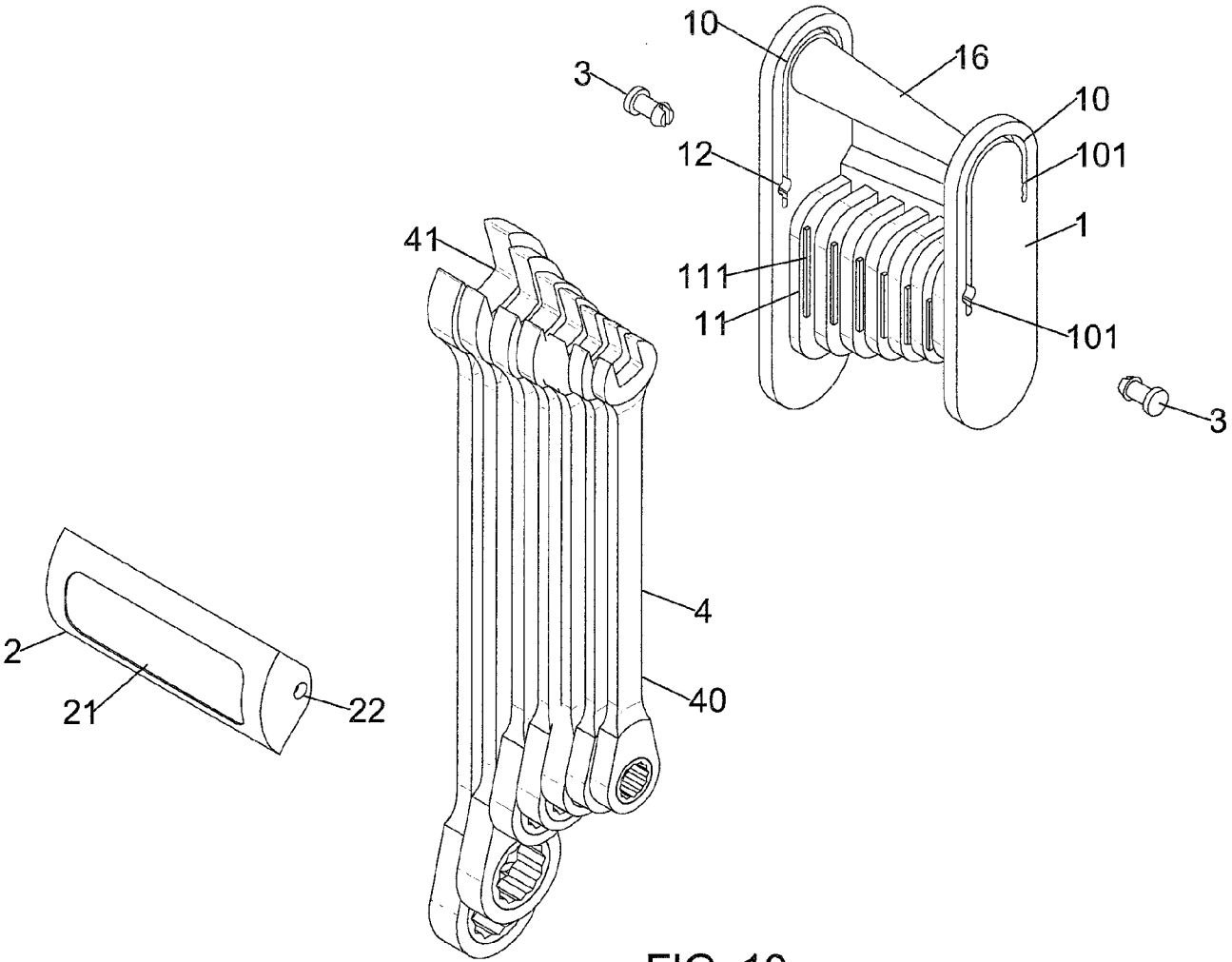
FIG. 10 is an exploded view to show the second embodiment of the present invention.
Figure 11:
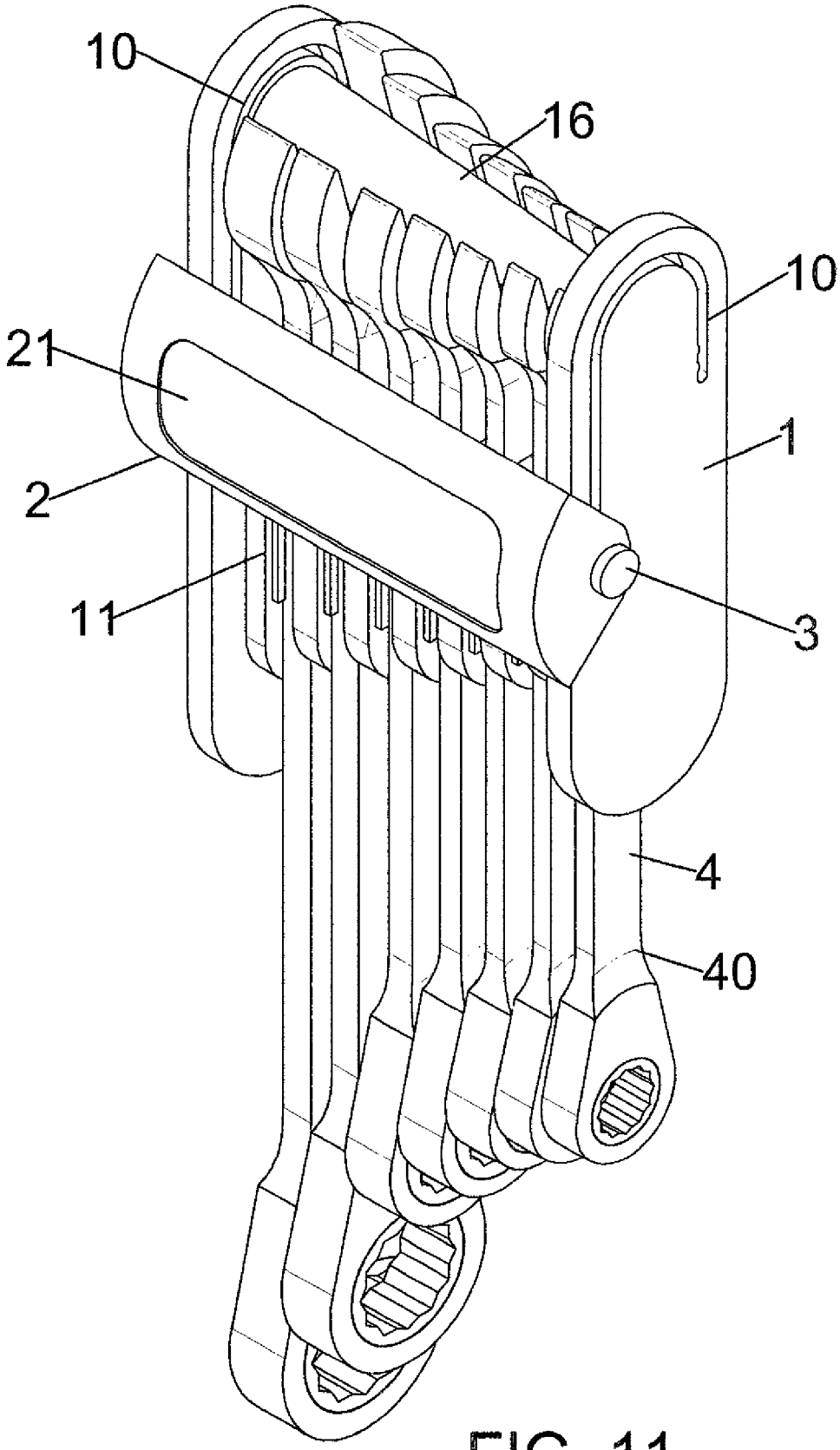
FIG. 11 is an assembly view to show the second embodiment of the present invention.

Referring to FIGS. 10 and 11, in the second embodiment of the invention, there is a locking hole 22 on each curved side plate 25 of the front cover panel 2. The locking members 3 penetrate both locking holes 22 of the front cover panel 2 and pin holes 12 of the main frame 1. Therefore, the front cover panel 2 can be fixed in position in front of the main frame 1.

Figure 12:
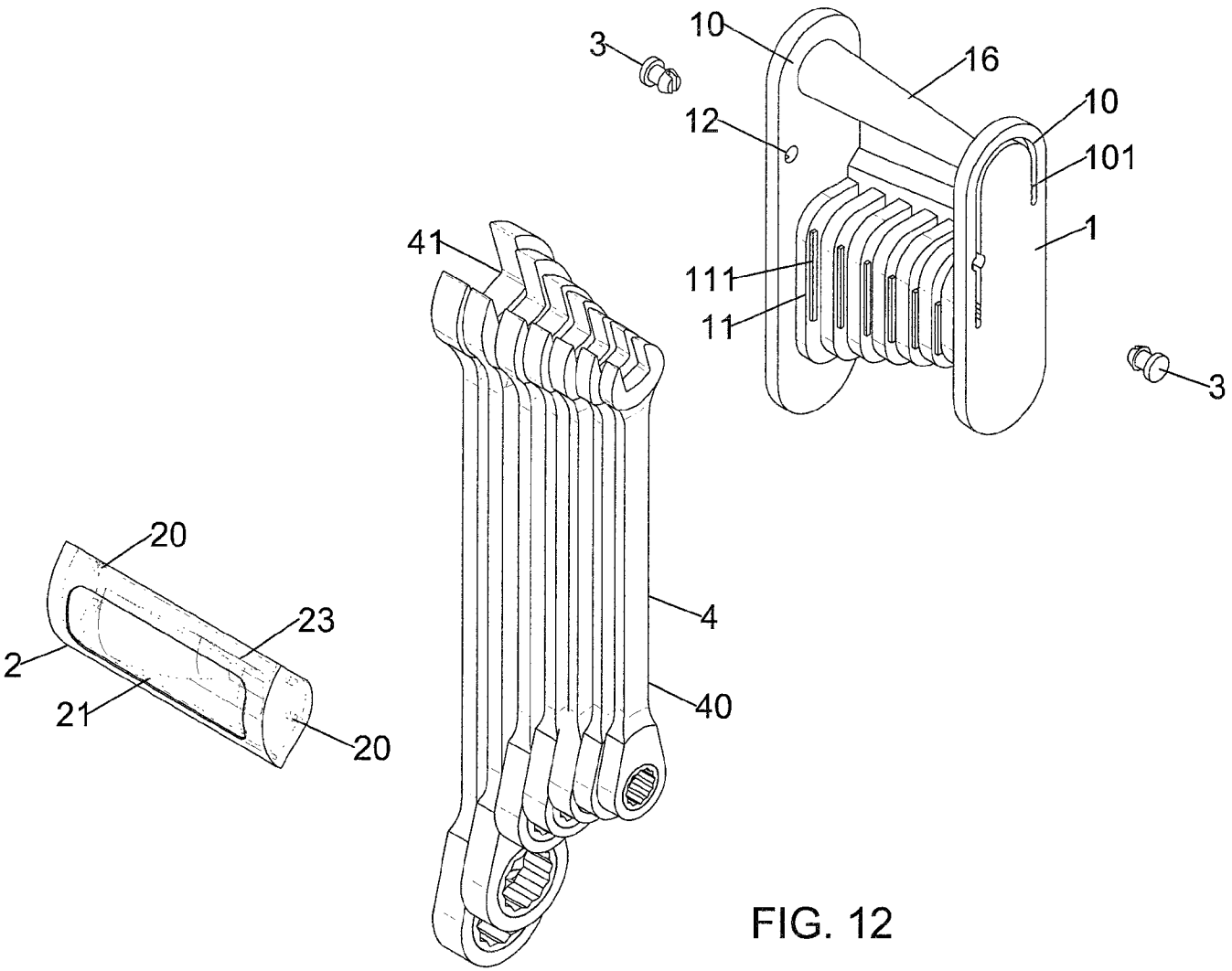
FIG. 12 is an exploded view to show the third embodiment of the present invention.

Referring to FIG. 12, in the third embodiment of the invention, the guiding slot 10 is not thoroughly drilled through the side plate 17, but is only a groove on the outer wall of the side plate 17. The protruding columns 20 do not have fungus shape heads, and they are located on the inner wall of each curved side plate 25 as an option.

Figure 13:
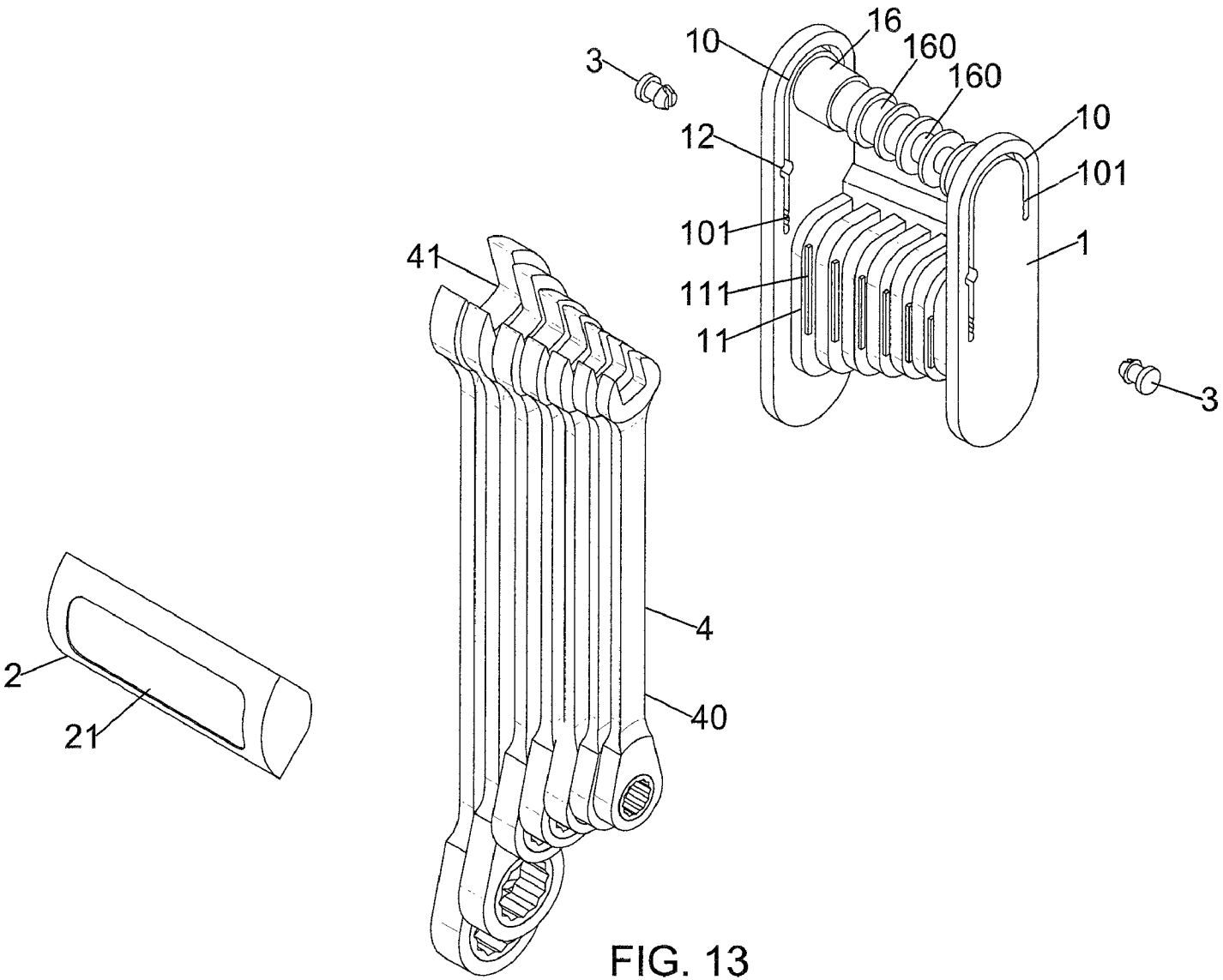
FIG. 13 is an exploded view to show the fourth embodiment of the present invention.

Referring to FIG. 13, in the fourth embodiment of the invention, there are multiple thin cylindrical stops 160 around the axial rod 16, and they are located corresponding to the receiving recesses 11. Each cylindrical stop 160 allows one opening 410 of the driving head 41 of the wrench 4 to be held on and located.

Figure 14:
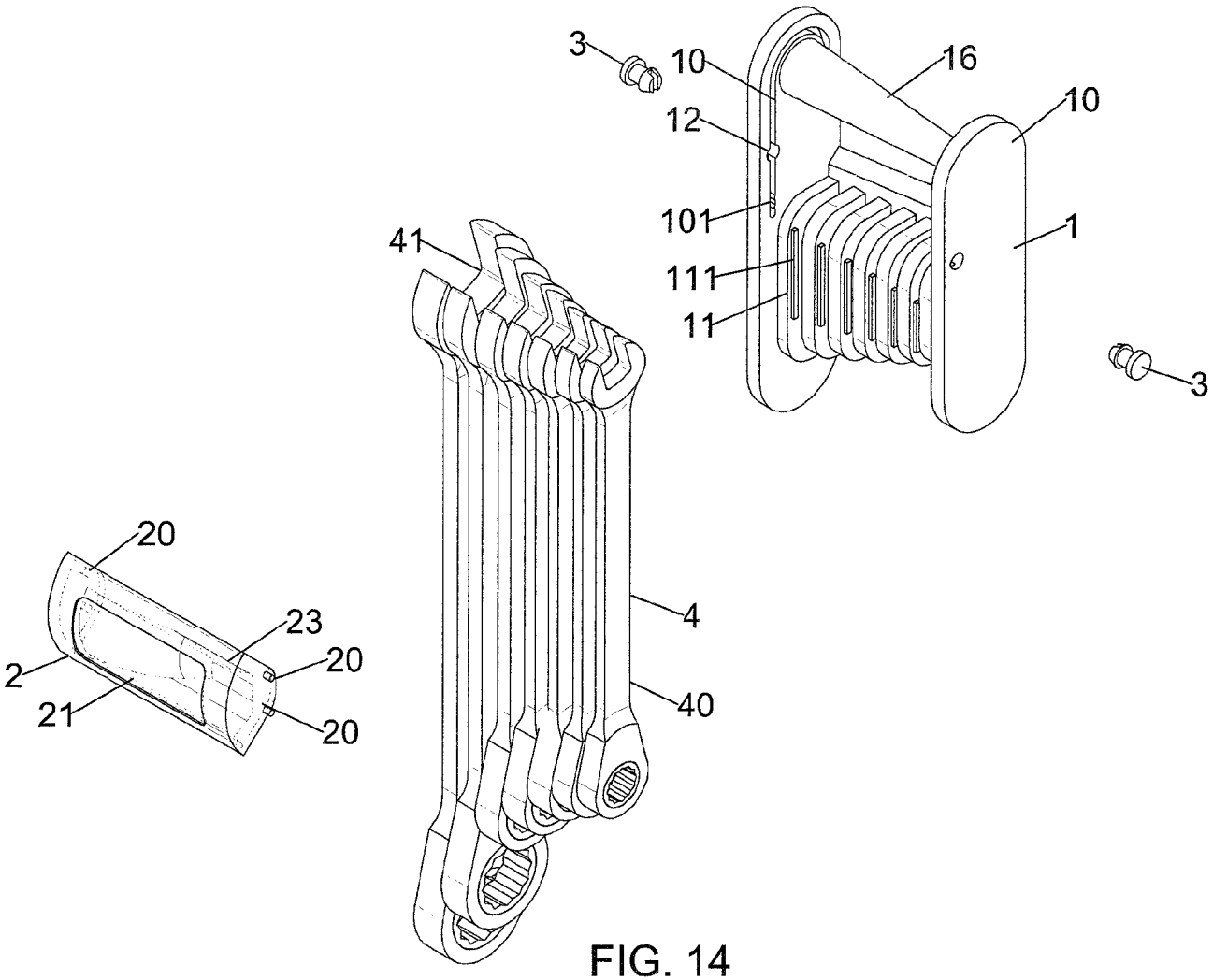
FIG. 14 is an exploded view to show the fifth embodiment of the present invention.
Figure 15:
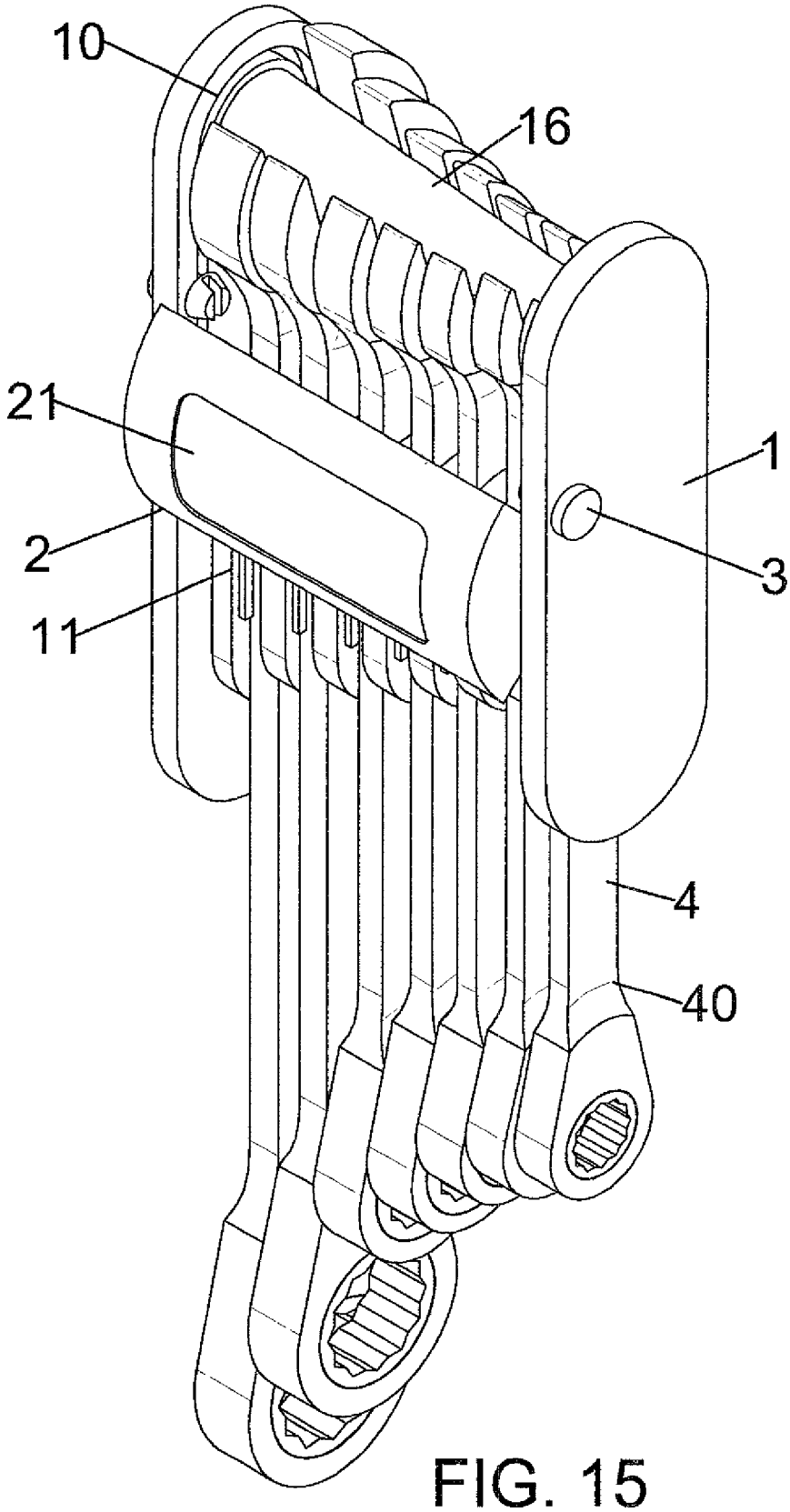
FIG. 15 is an assembly view to show the fifth embodiment of the present invention.

Referring to FIGS. 14 and 15, in the fifth embodiment of the invention, the guiding slot 10 is not thoroughly drilled through the side plate 17, but is only a groove on the inner wall of the side plate 17. The protruding columns 20 do not have fungus shape heads, and they are located on the outer wall of each curved side plate 25 as another option.

Figure 16:
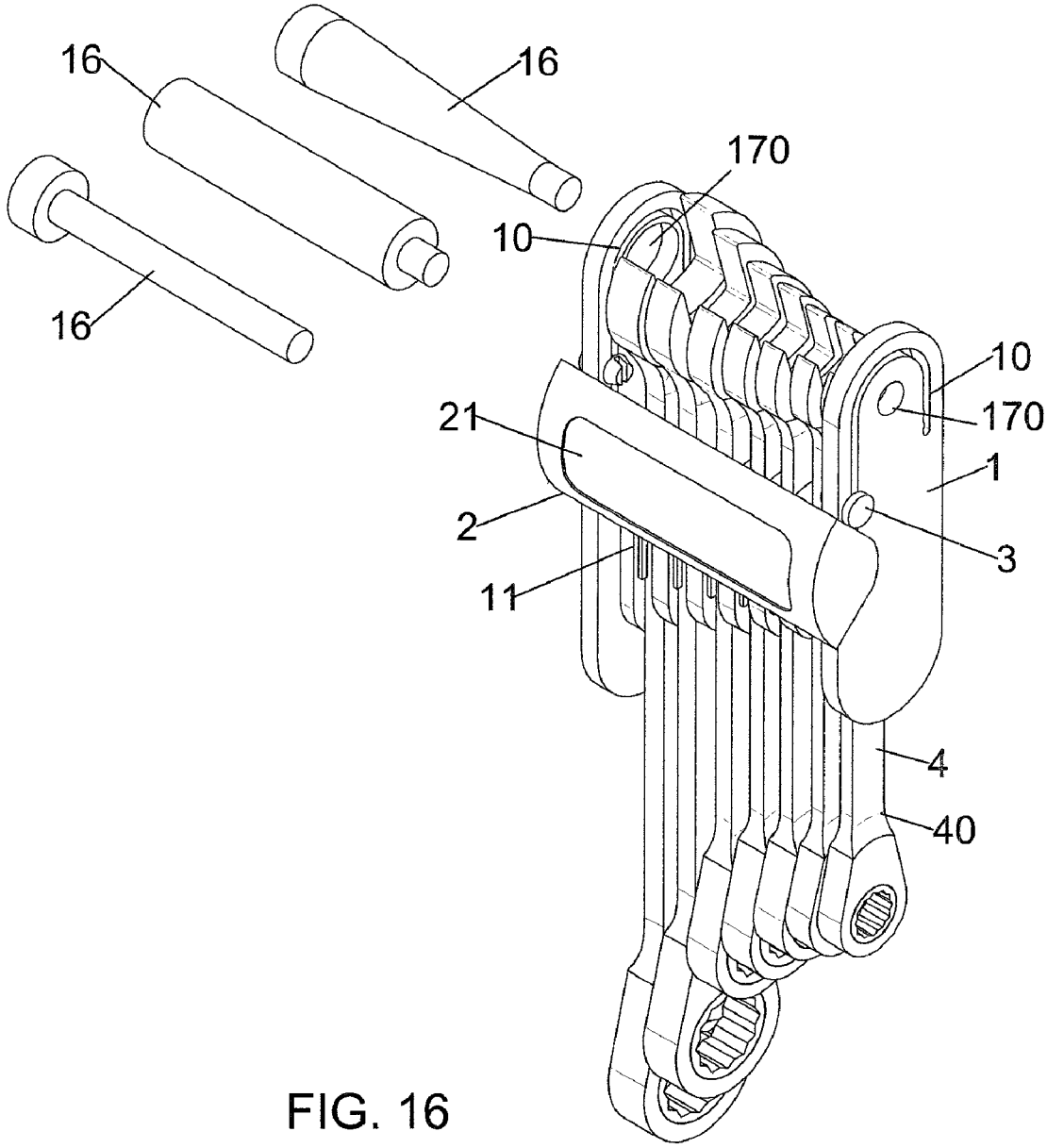
FIG. 16 is a schematic drawing to show the sixth embodiment of the present invention.

Referring to FIG. 16, in the sixth embodiment of the invention, there is a function for the axial rod 16 to be changeable. The axial rod 16 is an independent piece with respect of the side plates 17. The holes 170 on the side plates 17 allow the axial rod 16 to be inserted with different shapes.

Figure 17:
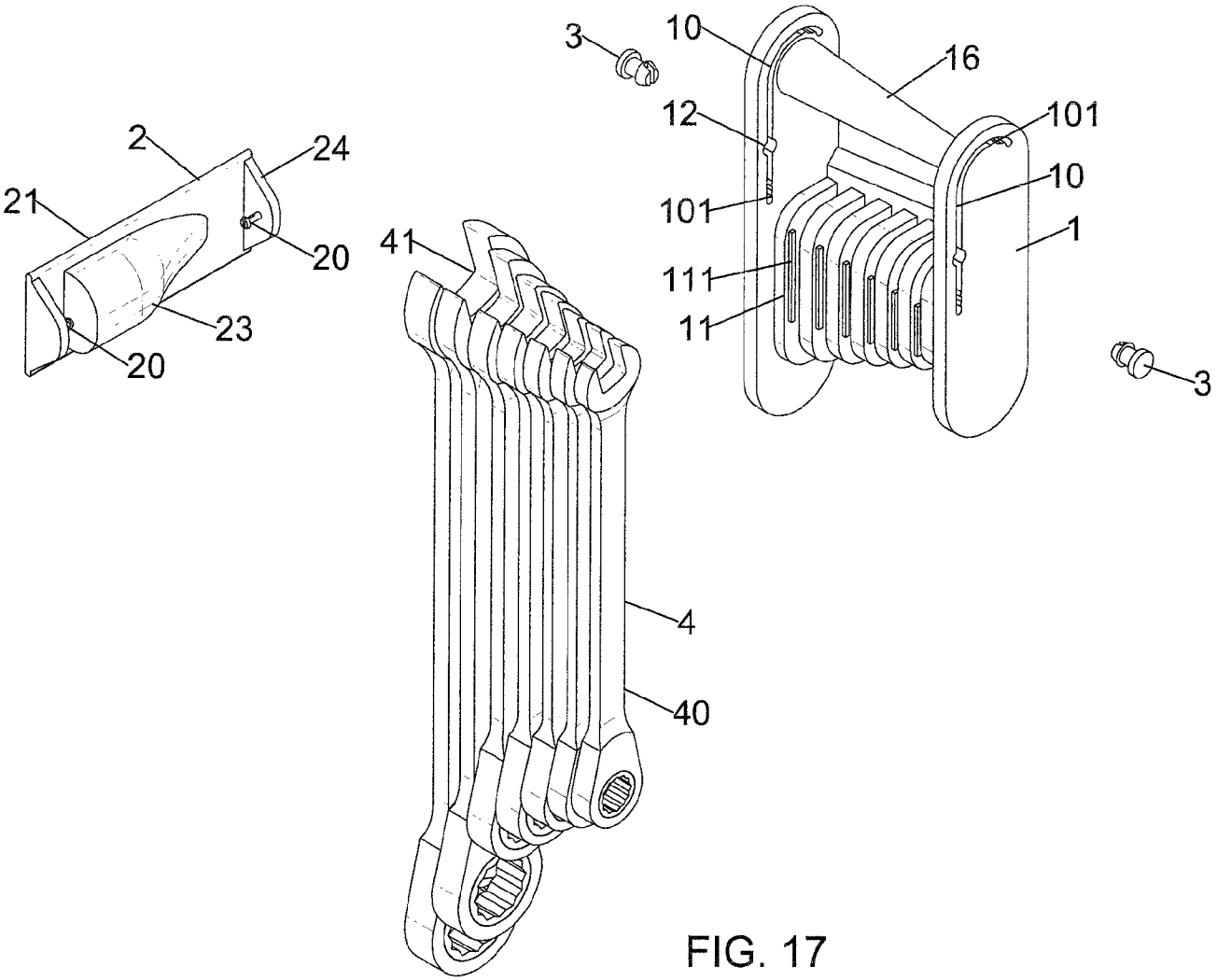
FIG. 17 is an exploded view to show the seventh embodiment of the present invention.
Figure 18:
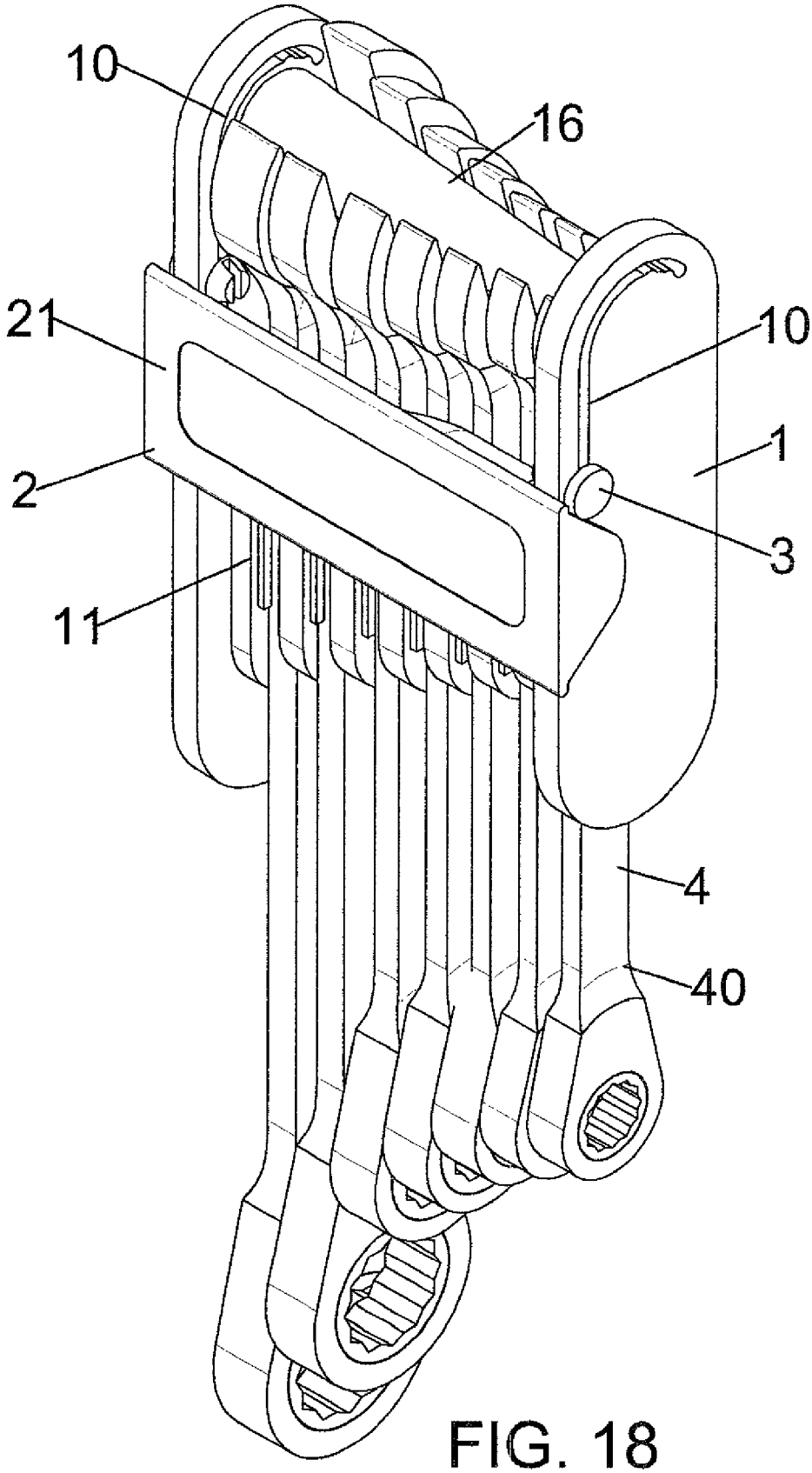
FIG. 18 is an assembly view to show the seventh embodiment of the present invention.

Referring to FIGS. 17 and 18, in the seventh embodiment of the invention, the cover plate 21 of the front cover panel 2 is a flat rectangle plate. The quantity of the protruding column 20 on the curved side plate 25 of the front cover panel 2 is one The advantages of the present invention are stated as follows:

1. After the assembly of the main frame and the front cover panel, the overall appearance of the tool rack is neat due to the coverable front panel. In term of visual effect, it looks much nicer.

2. The front cover panel on the main frame is moveable and is open and close controllable to prevent from stealing. The front cover panel installed on the main frame will not fall apart easily.

3. The wrenches can be uprightly placed in parallel on the main frame. It can save space to locate wrenches.

4. The driving head's opening of the wrench engaged upon the axial rod and the shank not only held within the receiving recess but also restricted by the raised strip can effectively fix the wrench in position.

5. The shank of the wrench held within the receiving recess and the neck of the wrench supported by the top edge of the connecting plate can prevent the wrench from falling.

6. The curved edge of the front cover panel is extended in accordance with the width of the shank of the wrench. It can reduce the gap between the shank and the front cover panel.

7. The various diameters of the axial rod can be used to match different openings of the wrenches' driving heads in size. The wrench can be placed in accordance with its size, and it is easier to identify when the user is going to pick the wrench next time.

While we have shown and described the embodiment in accordance with the present invention, it should be clear to those skilled in the art that further embodiments may be made without departing from the scope of the present invention.

What is claimed is:

1. A tool rack provided for placing with multiple wrenches, a middle portion of each wrench (4) being a shank (40) whose one end connects with a driving head (41) having a U-shaped opening (410), and the tool rack comprising:

a main frame (1) including two side plates (17), a connecting plate (13) horizontally linking between the side plates (17), and an axial rod (16), the side plates (17) located on both sides of the main frame (1) respectively, the connecting plate (13) positioned at a rear side of the main frame (1), and the axial rod (16) connecting the side plates (17) and positioned on a top of the main frame (1) for the openings (410) of the wrenches (4) to hold on, each side plate (17) having a long and narrow guiding slot (10) and a locking hole (12), the guiding slot (10) starting from a rear end of the side plate (17) and extending around the axis of the axial rod (16), and ending to a front end of the side plate (17), among the side plates (17) and the connecting plate (13) there are a plurality of receiving recesses (11) laterally established in parallel, each receiving recess (11) having an opening (110) facing to a front side of the main frame (1) so as to allow the shank (40) of the wrench (4) to be engaged therein, at least a raised strip (111) provided on the inner wall of the opening (110) to keep the shank (40) from moving;

a front cover panel (2) including a cover plate (21) and two curved side plates (25), the two curved side plates (25) located on both sides of the cover plate (21), for connecting to the side plates (17) of the main frame (1), each curved side plate (25) having at least one protruding column (20) used to insert into the guiding slots (10), the cover plate (21) provided for covering the opening (110) of the receiving recesses (11), and a curved edge (23) laterally extended along the rear side of the cover plate (21); and two locking members (3) respectively inserted through the locking holes (12) of the main frame (1) for restricting against a top edge (24) of the side plates (25) so that the front cover panel (2) can be fixed in front of the receiving recesses (11).

2. The tool rack as claimed in claim 1, wherein the inner sidewalls of the both distal ends of the guiding slot (10) have extruded a plurality of stopping edges (101) therefrom.

3. The tool rack as claimed in claim 1, wherein the locking hole (12) is positioned on the guiding slot (10) and has an inner diameter larger than the width of the guiding slot (10).

4. The tool rack as claimed in claim 1, wherein the plurality of receiving recesses (11) is seven.

5. The tool rack as claimed in claim 1, wherein the axial rod (16) is axially tapered.

6. The tool rack as claimed in claim 1, wherein a bottom portion of the driving head (41) is defined by a conjunction neck (42) between the driving head (41) and the shank (40), the conjunction neck (42) is supported by a top edge (131) of the connecting plate (13).

7. The tool rack as claimed in claim 1, wherein a distal end of each protruding column (20) is provided a head (200) thereon with a bigger diameter than the column (20).

8. The tool rack as claimed in claim 1, wherein a front side of the cover plate (21) is a curved surface.

9. The tool rack as claimed in claim 1, wherein there is a plurality of cylindrical stops (160) around the axial rod (16), each cylindrical stop (160) allows the opening (410) of one driving head (41) of the wrench (4) to be held on.

10. The tool rack as claimed in claim 1, wherein the axial rod (16) is an independent piece with respect of the side plates (17), and there are holes (170) on the side (5) plates (17) allowing the axial rod (16) to be inserted and fixed.

* * * * *